United States Patent [19]

Takeda et al.

[11] 4,456,637

[45] Jun. 26, 1984

[54] SYSTEM FOR COATING AND REMOVING EXCESS MATERIAL FROM A MOVING WEB

[75] Inventors: Hideo Takeda; Tsunehiko Sato, both of Kanagawa, Japan

[73] Assignee: Fuji Photo Film Co., Ltd., Kanagawa, Japan

[21] Appl. No.: 359,448

[22] Filed: Mar. 18, 1982

[30] Foreign Application Priority Data

Mar. 20, 1981 [JP] Japan ..... 56-41060

[51] Int. Cl.[3] ..... B05D 3/12; B05C 11/02

[52] U.S. Cl. ..... 427/355; 118/116; 118/118; 118/119; 118/126

[58] Field of Search ..... 427/355; 118/112, 118, 118/123, 244, 116, 119, 126

[56] References Cited

U.S. PATENT DOCUMENTS

| | | | |
|---|---|---|---|
| 3,785,340 | 1/1974 | Stafford et al. | 118/118 X |
| 4,128,077 | 12/1978 | Meier | 118/118 X |
| 4,238,533 | 12/1980 | Pujol et al. | 118/118 X |
| 4,263,351 | 4/1981 | Kazama et al. | 427/355 |

*Primary Examiner*—Michael R. Lusignan

*Attorney, Agent, or Firm*—Sughrue, Mion, Zinn, Macpeak and Seas

[57] ABSTRACT

A web coating method and apparatus includes a web scraping mechanism arranged after a coating section, the scraper being in the form of a wire bar. The scraping efficacy of the device is improved by forming the wire bar from small gauge wire wound upon a circular or polygonal rod, where the radius of curvature of the wire is 2 mm or less. If desired, the wire bar may be rotated relative to the web as scraping is effected.

8 Claims, 5 Drawing Figures

SYSTEM FOR COATING AND REMOVING EXCESS MATERIAL FROM A MOVING WEB

BACKGROUND OF THE INVENTION

This invention relates to a coating method in which a coating solution is applied to a continuously moving web to form a coated film thereon and an apparatus for practicing the method, and more particularly to a coating method in which an excessive amount of coating solution applied to the web is scraped off to form a coated film having a desired thickness, to thereby improve the so-called "metering system", and an apparatus for practicing the method.

The term "web" as used herein is intended to refer to a relatively long flexible belt-shaped support of a plastic film made of cellulose triacetate, polyamide, polyimide, polycarbonate, polyethylene terephthalate or polyvinyl chloride; or which is made of paper or synthetic paper or of a metal foil of aluminum, copper or the like; or which is made of a sheet of glass, ceramic or the like.

The term "coating solution" as used herein is intended to mean various coating solutions which are prepared in various solution compositions according to their objects of use. Examples of coating solutions are those for forming a photographic emulsion layer, a base layer, a protective layer, a back layer or the like in a photographic sensitized material; or those for forming a magnetic layer, a base layer, a lubricant layer, a protective layer, a back layer or the line in a magnetic recording medium, or those for forming an adhesive layer, a coloring layer, a rust proofing layer, etc. These coating solutions contain water soluble binders or organic binders.

A conventional coating means such as a dip, reverse roll, gravure roll, extrusion hopper or slide hopper is used to excessively apply the above-described coating solution to a web which is continuously run. Thereafter, a metering means such as an air knife, blade or wire bar is abutted against the layer formed on the web to scrape off an excessive amount to leave a desired thickness of coating solution.

However, the aforementioned metering means are disadvantageous in the following points:

1. In the case of the air knife, it requires substantial time and effort to uniformly set the air pressure distribution in the widthwise direction of the web and to maintain the air pressure distribution. The air knife suffers from problems in that the coating solution scraped off by the blowing air is scattered or forms bubbles, thus degrading the surface quality of the coated film, and lowering the recovery rate of the removed coating solution.

2. The blade's sharp edge abuts the coated film to remove an excessive amount of coating solution threfrom. Accordingly, the edge is greatly worn depending on the material of the web and the composition of the coating solution. Thus, the thickness and surface quality of the coated film cannot be shiftably controlled without frequently performing maintenance of an inspection of the edge.

3. In general, a wire bar which is formed as follows has been extensively employed: A metal wire is wound on a rod member to form a coil whose turns are close to one another. The outside diameter of the coil formed on the rod member is usually set between 10 and 20 mm.

The wire bar will be described in more detail with reference to FIG. 1. In this figure, the aforementioned coating means 1 is used to apply a coating solution L, the amount of which is usually several times the final amount of coating solution, to a web W which runs continuously in the direction of the arrow A. The aforementioned wire bar 2 is set across the web W and downstream of the coating means 1 and is pushed against the film LL of coating solution L coated on the web, so that an excessive amount EL of coating solution is scraped off the coated film LL by the outer wall of the wire member of the wire bar. Thus, only the coated film passed through the gap between the surface of the web W and the outer wall of the wire member wound on the wire rod becomes the final coated film, which is thereafter dried.

The above-described wire bar 2 is a useful metering technique because it is very simple in construction, maintenance and handling, and can provide a coated film of stable surface quality.

However, with respect to the scraping off of an excessive amount of coating solution and the provision of a stable surface quality, the use of the wire bar 2 is limited in the case where a coating solution L of high viscosity is applied at high speed to the web to form a thin coated film thereon.

SUMMARY OF THE INVENTION

The present inventors have conducted intensive research in metering systems in order to eliminate the above-described drawbacks accompanying the conventional metering system, resulting in the coating method and apparatus for practicing the method, which are described below.

Firstly, the inventors have strived to improved the applicability to high speed film coating of the wire bar, which is advantageous in construction and operation when compared with the other metering means as noted above.

In this research, it has been found, as can be seen from the following relation, that for an thin air layer formed between the web W and its rotary support, (such as a guide roll) the outside diameter of the above-described wire bar greatly affects the applicability to high speed film coating of a highly-viscous coating solution thereof.

$$h_O \propto R\left(\mu \cdot \frac{v+u}{T}\right)^{\frac{2}{3}}$$

where $h_O$: web floating height
R: roll outside diameter
$\mu$: fluid viscosity
v: web speed
u: roll speed
T: web tension An object of this invention is to provide a coating method in which the above-described drawbacks accompanying a conventional metering system have been eliminated and where a coated film of high quality can be formed at high speed irrespective of the properties of the coating solution, and an apparatus for practicing the method.

The foregoing object and other objects of the invention have been achieved by the provision of a coating method and a coating apparatus in which the coating solution is excessively applied to a web which is continuously run along a predetermined web running path, and thereafter the scraping surface of a metering means, which has a radius of curvature of 2 mm or less, is abutted against a coated film formed on the web to scrape an excessive amount of coating solution from the coated film to thereby obtain a coated film having a desired thickness.

BRIEF DESCRIPTION OF THE DRAWINGS

Embodiments of this invention will be described with reference to the accompanying drawings, in which.

DETAILED DESCRIPTION OF THE PREFERRED EMBODIMENTS

Figure 2:
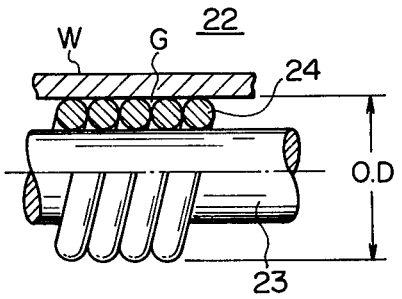
FIG. 2 is a side view showing the essential components of a metering system according to the invention.

A metering means according to the invention is illustrated in FIG. 2. A wire bar 22, is formed by winding a wire member 24 on a rod member 23 in such a manner that the wire member 24 forms a single coil whose turns are close to one another. Therefore, the wire bar 22 is similar to the aforementioned conventional wire bar 2 in this point; however, the former is significantly different from the latter in the maximum outside diameter OD of the single coil wound on the rod member.

The rod member 23 of the wire bar 22 is a stainless steel, iron or brass rod having an outside diameter of 1 to 3 mm, and the wire member 24 of the wire bar 22 is a stainless or "Teflon" wire having an outside diameter of 0.04 to 0.5 mm. A specific feature of the wire bar 22 is that the wire bar 22 made up of the rod member 23 and the wire member 24 has an overall outside diameter of 4 mm or less.

Figure 1:
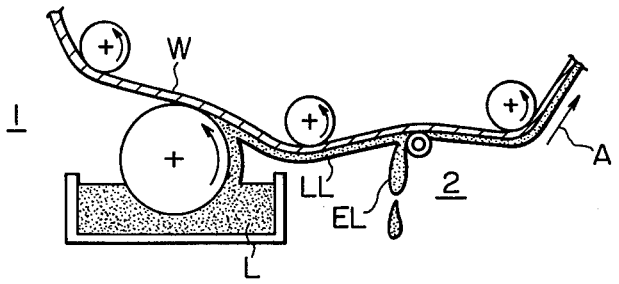
FIG. 1 is an explanatory diagram for describing a conventional metering system.

When the conventional wire bar 2 in FIG. 1 is replaced by the wire bar 22, the gap G (FIG. 2) between the web W and the outer wall of the wire bar 22, i.e., the outer wall of the wire member 24 wound on the rod member 23, is decreased as the diameter of the wire member 24 is decreased, and accordingly the above-described coated film scraping effect is increased and the film can be formed as a very thin layer. However, as the web running speed V and the viscosity $\mu$ of the coating solution L increase, the scraping effect is decreased and therefore it is difficult to form a thin film. This fact can be readily understood from the above-described expression, i.e. from the fact that the web floating height $h_O$ is increased in proportion to the web running speed V and the fluid viscosity $\mu$.

In view of the foregoing, the maximum outside diameter OD of the wire bar 22 according to the invention is set to 4 mm or less, which is smaller by about 1/25 to 1/5 the outside diameter (usually 10 to 20 mm) of the conventional device. As a result, even if the web running speed V and the coating solution viscosity $\mu$ are greatly increased, the above-described web floating phenomenon can be completely prevented and the scraping effect of the wire bar 22 is sufficiently obtained.

Figure 5:
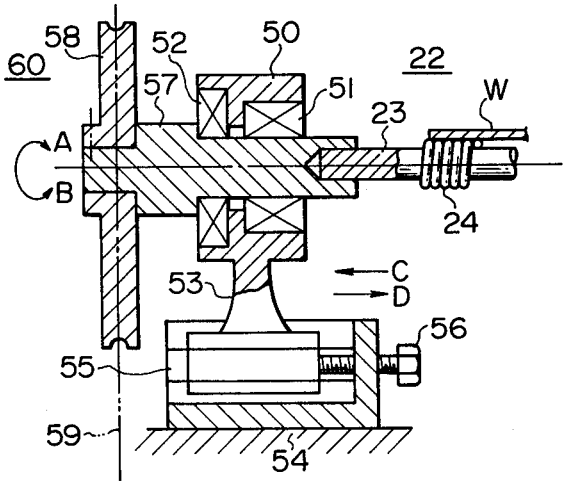
FIG. 5 is a sectional view of a bearing means and a rotary drive system of the metering system.

In the case where the wire bar 22 is disposed downstream of the above-described coating means 1, it is preferable that the wire bar 22 be used in combination with a bearing 50 and a rotary drive system 60 as shown in FIG. 5.

The bearing 50 comprises a housing; a radial bearing mechanism 51 and a thrust bearing mechanism 52 which are fitted in the housing; and a leg 53 extended from the housing. The leg 53 is mounted on a slide stand 55 fixedly secured to a frame 54 in such a manner that the leg 53 is slidable in the directions of the arrows C and D, i.e. in the axial direction of the wire bar 22.

The leg 53 of the bearing 50 is engaged with one end of a screw member 56 screwed into the slide stand 55.

The thrust bearing mechanism 52 and the radial bearing mechanism 51 rotatably support a rotary shaft 57 which is slightly larger in diameter than the rod member 23.

The rotary drive system 60 consists of a pulley 58 and a belt 59. The rotary drive system 60 is fitted on one end portion of the rotary shaft 57, and the end portion of the rod member 23 is fixedly secured to the other end portion of the rotary shaft 57.

When the above-described coated film LL is scraped with the rod member 23 secured to the bearing means 50 and the drive system, it is preferable to further tighten the screw member 56 to exert a force in the direction of the arrow C, namely, a tensile force on the rod member 23. This prevents a problem where the wire bar is bent or twisted by its own weight and the web tension.

When scraping of the coating film begins, a drive source (not shown) is operated continuously or intermittently to rotate the wire bar 22 in the web running direction A or in the opposite direction B at a speed which will not greatly affect the amount of scraping. In this case, the entire outer wall of the wire member 24 is maintained wet by the coating solution, which prevents a problem where the coating solution scraped onto the outer wall of the wire member 24 dries and solidifies to form streaks or longitudinal stripes on the coated film, which degrades the quality of the product.

In the case where the length of the wire bar 22 is relatively long, an auxiliary supporting stand may be set inside the bearing means 50 to support the lower outer wall of the wire bar 22.

Depending on the bending rigidity of the wire bar 22, the tensile force exerted on the rod member should be adjusted, or eliminated.

In the above-described embodiment, a pulley and belt are employed to transmit torque; however, they may, however, be replaced by a chain sprocket and a chain, or a gear train, or a handle, etc. The torque transmitting system may be omitted if the coating time, or the scraping time, is relatively short.

Figure 3:
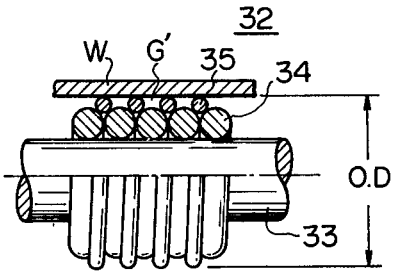
FIGS. 3 and 4 are schematic diagrams showing modifications of the metering system according to the invention.

FIG. 3 is a side view of one modification of the wire bar according to the invention. The wire bar 32 in this modification is so-called "double-coil" type bar which is formed as follows: A wire member 34 is wound on a rod member 33 of circular section to form a single coil, and then a wire member 35 of a diameter smaller than the wire member 34 is wound on the single coil, so that double coils are formed on the rod member 33. The maximum outside diameter OD of the double-coil type wire bar 32 is 4 mm or less.

The gap G' between the web W and the outer wall of the coil formed with the wire member 35 is larger than the gap G of single-coil type wire bar 22. Therefore, the amount of coated film (LL) passing through the gap is increased. Accordingly, the modification has an advantage in that a coating solution L having a relatively high viscosity can be applied at high speed.

The diameter of the wire member 35 may range from about 1/10 to 1/1.5 of the diameter of the other wire member 34.

Figure 4:
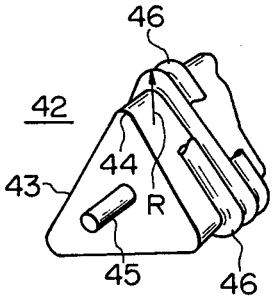

FIG. 4 shows another modification of the metering means according to the invention. In this modification, the rod member 43 is triangular in section. A wire member 46 is wound on the rod member 43 with a radius of curvature R of 2 mm or less at each of three edges of the rod member 43, to form scraping surfaces. Supporting shafts 45 are connected to both ends of the rod member 43, so that the metering means is rotatably supported.

The bar 42 thus formed is advantageous in that, since it is of triangular section, its bending rigidity is high and accordingly the bar will not significantly be bent. Thus, the bar 42 may be compact in structure and yet achieve the objects of this invention. However, since three distinct scraping surfaces are formed, it is more desirable to switch the scraping surfaces when the web W passes through the film coating region or stops than to continuously rotate the wire bar 42.

A polygonal rod member of square or pentagonal section may be employed if the radius of curvature R is 2 mm or less at each of the edges thereof. By winding the wire members 24, 34 and 35 on these rod members. various wire bars can be obtained.

That is, if the radius of curvature R of each scraping surface and the outside diameter of the wire bar are 2 mm or less and 4 mm or less, respectively, the object of the invention can be achieved.

In order to clarify the novel effects of the invention, concrete examples and a comparison example will be described.

EXAMPLE 1

A coating solution having the following solution composition (A) was applied with a gravure roll to a thickness of 30 μm to a polyethylene terephthalate film 15 μm in thickness and 50 cm in width which was continuously run. Thereafter, metering was carried out with the wire bars shown in FIGS. 2, 3 and 4, to form coated film layers of the (A) solution. These coated film layers were checked for film layer thickness and surface quality.

The metering conditions and the results are as indicated in Table 1.

| Solution composition (A) | |
|---|---|
| Gelatin/$H_2O$ | 2 to 7/100 parts |
| Solution viscosity | 3 to 10 Cp |

EXAMPLE 2

A coating solution having the following solution composition (B) was applied under the same conditions as those in Example 1 to form coated film layers. These coated film layers were checked for thickness and surface quality.

The metering conditions and the results are as indicated in Table 1.

| Solution composition (B) | |
|---|---|
| Ferromagnetic powder | ($\gamma$-$Fe_2O_3$, grain size 0.6 μm) 500 parts by weight |
| Nitrile cellulose | 100 parts by weight |
| Dibutyl phthalate | 20 parts by weight |
| Lecithin | 1500 to 2500 parts by weight |
| Solution viscosity | 5 to 20 Ps |

COMPARISON EXAMPLE 1

Under the same conditions as those of Example 1 except that a single-coil type wire bar having an outside diameter of 6 mm was used which was made up of a rod 5.7 mm in diameter, and a wire 0.15 mm in diameter, the coating solutions (A) and (B) were applied. The metering conditions and the results were as indicated in Table 1.

It has been confirmed from these results that the invention (Examples 1 and 2) is much better in terms of surface quality and high speed film coating applicability than the conventional system (Comparison Example 1).

TABLE 1

| | CONDITIONS | | | | | | | | RESULTS | | |
|---|---|---|---|---|---|---|---|---|---|---|---|
| | | | COATING SOLUTIONS | | METERING | | | | | | |
| EXAMPLES | WEB SPEED | COATING TIME | COMP. | VISCOSITY | ROTARY DRIVE | WIRE WINDING | WIRE BAR O.D. | TRIANGULAR BAR R | FILM THICKNESS (DRIED) | SURFACE QUALITY (LONGITUDINAL STRIPES) Hmax | REMARKS (NOTES) |
| Example 1 | 100 m/min | 1 hr | A SOLUTION | 3 cp | N/A (NOT APPLIABLE) | SINGLE COIL | 4 mm | | 0.5 μm | 0.03 μm | 1. In the Examples 1 and 2, a single-coil or double-coil type wire bar formed by winding a wire of 0.06 to 0.15 mm in diameter was used. 2. For the surface quality of the coated film, the formation of longitudinal stripes was detected from the surface roughness (Mmax) in the widthwise direction of the web. The surface roughness was measured with stylus type surface configuration meter (SURECOM 20C) manufactured by Tokyo Seimitsu Co., Ltd. |
| | 100 m/min | 1 hr | A SOLUTION | 3 cp | N/A (NOT APPLIABLE) | SINGLE COIL | 3 mm | | 0.5 μm | 0.03 μm | |
| | 100 m/min | 1 hr | A SOLUTION | 3 cp | N/A (NOT APPLIABLE) | SINGLE COIL | 2 mm | | 0.5 μm | 0.02 μm | |
| | 100 m/min | 1 hr | A SOLUTION | 6 cp | N/A (NOT APPLIABLE) | SINGLE COIL | 4 mm | | 0.8 μm | 0.05 μm | |
| | 100 m/min | 1 hr | A SOLUTION | 6 cp | N/A (NOT APPLIABLE) | SINGLE COIL | 3 mm | | 0.8 μm | 0.04 μm | |
| | 100 m/min | 1 hr | A SOLUTION | 6 cp | N/A (NOT APPLIABLE) | SINGLE COIL | 2 mm | | 0.8 μm | 0.04 μm | |
| | 100 m/min | 1 hr | A SOLUTION | 6 cp | N/A (NOT APPLIABLE) | SINGLE COIL | | 2 mmR | 0.8 μm | 0.06 μm | |
| | 100 m/min | 1 hr | A SOLUTION | 6 cp | N/A (NOT APPLIABLE) | SINGLE COIL | | 1.5 mmR | 0.8 μm | 0.05 μm | |
| | 100 m/min | 1 hr | A SOLUTION | 6 cp | N/A (NOT APPLIABLE) | SINGLE COIL | | 1.5 mmR | 0.8 μm | 0.04 μm | |
| | 300 m/min | 1 hr | A SOLUTION | 10 cp | N/A (NOT APPLIABLE) | SINGLE COIL | 4 mm | | 1.0 μm | 0.07 μm | |
| | 300 m/min | 1 hr | A SOLUTION | 10 cp | N/A (NOT APPLIABLE) | SINGLE COIL | 3 mm | | 1.0 μm | 0.07 μm | |
| | 300 m/min | 1 hr | A SOLUTION | 10 cp | N/A (NOT APPLIABLE) | SINGLE COIL | 2 mm | | 1.0 μm | 0.05 μm | |
| | 300 m/min | 1 hr | A SOLUTION | 10 cp | N/A (NOT APPLIABLE) | DOUBLE COIL | 4 mm | | 1.2 μm | 0.06 μm | |
| | 300 m/min | 1 hr | A SOLUTION | 10 cp | N/A (NOT APPLIABLE) | DOUBLE COIL | 3 mm | | 1.2 μm | 0.06 μm | |
| | 300 m/min | 1 hr | A SOLUTION | 10 cp | N/A (NOT APPLIABLE) | DOUBLE COIL | 2 mm | | 1.2 μm | 0.05 μm | |
| | [illegible] | [illegible] | B | 5 cp | N/A | SINGLE | 4 mm | | [illegible] | [illegible] | |

TABLE 1-continued

| | CONDITIONS | | | | | | | | RESULTS | | |
|---|---|---|---|---|---|---|---|---|---|---|---|
| | | | COATING SOLUTIONS | | METERING | | | | | | |
| EXAMPLES | WEB SPEED | COATING TIME | COMP. | VISCOSITY | ROTARY DRIVE | WIRE WINDING | WIRE BAR O.D. | TRIANGULAR BAR R | FILM THICKNESS (DRIED) | SURFACE QUALITY (LONGITUDINAL STRIPES) Hmax | REMARKS (NOTES) |
| ample 2 | 100 m/min | 1 hr | SOLUTION B | 5 ps | N/A | COIL SINGLE | 3 mm | | 2.1 μm | 0.05 μm | |
| | 100 m/min | 1 hr | SOLUTION B | 5 ps | N/A | COIL SINGLE | 2 mm | | 2.1 μm | 0.05 μm | |
| | 100 m/min | 1 hr | SOLUTION B | 10 ps | N/A | COIL SINGLE | 4 mm | | 2.1 μm | 0.06 μm | |
| | 100 m/min | 1 hr | SOLUTION B | 10 ps | N/A | COIL SINGLE | 3 mm | | 2.1 μm | 0.05 μm | |
| | 100 m/min | 1 hr | SOLUTION B | 10 ps | N/A | COIL SINGLE | 2 mm | | 2.1 μm | 0.05 μm | |
| | 100 m/min | 1 hr | SOLUTION B | 10 ps | N/A | COIL SINGLE | | 2 mmR | 2.1 μm | 0.07 μm | |
| | 100 m/min | 1 hr | SOLUTION B | 10 ps | N/A | COIL SINGLE | | 1.5 mmR | 2.1 μm | 0.06 μm | |
| | 100 m/min | 1 hr | SOLUTION B | 10 ps | N/A | COIL SINGLE | | 1.0 mmR | 2.1 μm | 0.06 μm | |
| | 300 m/min | 1 hr | SOLUTION B | 20 ps | N/A | COIL SINGLE | 4 mm | | 2.2 μm | 0.08 μm | |
| | 300 m/min | 1 hr | SOLUTION B | 20 ps | N/A | COIL SINGLE | 3 mm | | 2.2 μm | 0.07 μm | |
| | 300 m/min | 1 hr | SOLUTION B | 20 ps | N/A | COIL SINGLE | 2 mm | | 2.2 μm | 0.04 μm | |
| | 300 m/min | 1 hr | SOLUTION B | 20 ps | N/A | COIL SINGLE | 4 mm | | 2.5 μm | 0.05 μm | |
| | 300 m/min | 1 hr | SOLUTION B | 20 ps | N/A | COIL SINGLE | 3 mm | | 2.5 μm | 0.05 μm | |
| | 300 m/min | 1 hr | SOLUTION B | 20 ps | N/A | COIL SINGLE | 2 mm | | 2.5 μm | 0.04 μm | |
| Comparative Example 1 | 100 m/min | 1 hr | SOLUTION A | 3 cp | N/A (NOT APPLIABLE) | COIL DOUBLE | 6 mm | | 0.5 μm | 0.05 μm | |
| | 100 m/min | 1 hr | SOLUTION A | 6 cp | N/A (NOT APPLIABLE) | COIL DOUBLE | 6 mm | | 0.8 μm | 0.10 μm | |
| | 100 m/min | 1 hr | SOLUTION A | 10 cp | N/A (NOT APPLIABLE) | COIL DOUBLE | 6 mm | | 1.1 μm | 0.18 μm | |
| | 300 m/min | 1 hr | SOLUTION A | 3 cp | N/A (NOT APPLIABLE) | COIL DOUBLE | 6 mm | | 0.8 μm | 0.08 μm | |
| | 300 m/min | 1 hr | SOLUTION A | 6 cp | N/A (NOT APPLIABLE) | COIL DOUBLE | 6 mm | | 1.2–1.6 μm | 0.15 μm | |
| | 300 m/min | 1 hr | SOLUTION A | 10 cp | N/A (NOT APPLIABLE) | COIL DOUBLE | 6 mm | | 1.6–1.8 μm | 0.15–0.30 μm | |
| | 100 m/min | 1 hr | SOLUTION B | 5 ps | N/A (NOT APPLIABLE) | COIL DOUBLE | 6 mm | | 2.5 μm | 0.08 μm | |
| | 100 m/min | 1 hr | SOLUTION B | 10 ps | N/A (NOT APPLIABLE) | COIL DOUBLE | 6 mm | | 2.6 μm | 0.12 μm | |
| | 100 m/min | 1 hr | SOLUTION B | 20 ps | N/A (NOT | COIL DOUBLE | 6 mm | | 2.9 μm | 0.23 μm | |

TABLE 1-continued

| EXAMPLES | CONDITIONS: WEB SPEED | COATING TIME | COATING SOLUTIONS: COMP. | VISCOSITY | METERING: ROTARY DRIVE | WIRE WINDING | WIRE BAR O.D. | TRIANGULAR BAR R | RESULTS: FILM THICKNESS (DRIED) | SURFACE QUALITY (LONGITUDINAL STRIPES) Hmax | REMARKS (NOTES) |
|---|---|---|---|---|---|---|---|---|---|---|---|
| | | | SOLUTION | | APPLIABLE) | COIL | | | | | |
| | 300 m/min | 1 hr | B | 5 ps | N/A (NOT | DOUBLE | 6 mm | | 2.7 μm | 0.30 μm | |
| | | | SOLUTION | | APPLIABLE) | COIL | | | | | |
| | 300 m/min | 1 hr | B | 10 ps | N/A (NOT | DOUBLE | 6 mm | | 3.0–3.3 μm | 0.30 –0.38 μm | |
| | | | SOLUTION | | APPLIABLE) | COIL | | | | | |
| | 300 m/min | 1 hr | B | 20 ps | N/A (NOT | DOUBLE | 6 mm | | 3.0–3.8 μm | 0.5–1.00 μm | |
| | | | SOLUTION | | APPLIABLE) | COIL | | | | | |

What is claimed is:

1. A method of coating a web, comprising; excessively applying a coating solution to a web which is continuously run along a predetermined web running path, to form a coated film on said web, abutting a scraping surface of a metering means against said coated film, while wet, to scrape off an excess amount of coating solution from said coated film, to allow said coated film to have a desired thickness, said scraping surface being made of a wound wire member having a radius of curvature of 2 mm or less.

2. A coating apparatus, comprising;

coating means for applying a coating solution to a web, said web being continuously run along a predetermined web running path; and metering means having a scraping surface, said scraping surface being abutted against said web after said web has passed through said coating means, said scraping surface comprising a wire member with a radius of curvature of 2 mm or less.

3. A coating apparatus as claimed in claim 2, said metering means including a rotary drive mechanism, said scraping surface being rotated in either direction with respect to the movement of said web.

4. A coating apparatus as claimed in claims 2 or 3, said metering means including a wire bar comprising a circular rod member having a wire member wound thereon in the form of a single coil, said wire bar having a maximum outside diameter of 4 mm or less.

5. A coating apparatus as claimed in claims 2 or 3, said metering means including a wire bar comprising two wire members wound on a circular rod member in the form of double coils, said wire bar having a maximum outside diameter of 4 mm or less.

6. A coating apparatus as claimed in claims 2 or 3, said metering means including a wire bar comprising a wire member wound on a rod member of polygonal section, said wire member having a radius of curvature of 2 mm or less at each of the edges of said rod member, to form scraping surfaces.

7. A coating apparatus as claimed in claim 2, said metering means including a wire bar comprising a wire member wound on a circular rod member, said wire member being 0.5 mm or less in diameter.

8. A coating apparatus as claimed in claim 7, said wire bar being rotatably supported by supporting means for holding said wire bar under tension in the axial direction of said wire bar.

* * * * *